US009626948B2

(12) United States Patent
Bath

(10) Patent No.: US 9,626,948 B2
(45) Date of Patent: Apr. 18, 2017

(54) SYSTEMS AND METHODS FOR A VARIABLE APERTURE ELECTROMAGNETIC PICKUP FOR STRINGED MUSICAL INSTRUMENTS

(71) Applicant: Adam Bath, Plano, TX (US)

(72) Inventor: Adam Bath, Plano, TX (US)

( * ) Notice: Subject to any disclaimer, the term of this patent is extended or adjusted under 35 U.S.C. 154(b) by 0 days.

(21) Appl. No.: 14/988,865

(22) Filed: Jan. 6, 2016

(65) Prior Publication Data

US 2016/0196814 A1 Jul. 7, 2016

Related U.S. Application Data

(60) Provisional application No. 62/100,812, filed on Jan. 7, 2015.

(51) Int. Cl.
*G10H 3/00* (2006.01)
*G10H 3/18* (2006.01)

(52) U.S. Cl.
CPC ..... *G10H 3/183* (2013.01); *G10H 3/181* (2013.01); *G10H 3/182* (2013.01)

(58) Field of Classification Search
CPC G10H 3/181; G10H 3/18; G10H 3/26; G10H 3/182; G10H 2220/511; G10H 1/00; G10H 2220/505; G10H 3/186; G10H 3/183; G10H 2220/461; G10H 3/22; G10H 1/0555; G10H 2220/485; G10H 1/045; G10G 3/02; G10G 3/04; B06B 1/045
See application file for complete search history.

(56) References Cited

U.S. PATENT DOCUMENTS

| | | | | | |
|---|---|---|---|---|---|
| 3,657,461 | A * | 4/1972 | Freeman | G10H 3/181 | 84/726 |
| 5,111,728 | A * | 5/1992 | Blucher | G10H 3/182 | 84/726 |
| 5,290,968 | A * | 3/1994 | Mirigliano | G10H 3/181 | 84/726 |
| 5,530,199 | A * | 6/1996 | Blucher | G10H 3/181 | 84/728 |
| 2010/0122623 | A1* | 5/2010 | Salo | G10H 3/181 | 84/726 |
| 2012/0103170 | A1* | 5/2012 | Kinman | G10H 3/181 | 84/726 |
| 2013/0312591 | A1* | 11/2013 | Mills | G10H 3/181 | 84/726 |
| 2014/0033905 | A1* | 2/2014 | Rubman | G10H 3/181 | 84/726 |
| 2015/0379978 | A1* | 12/2015 | Jang | G10H 3/181 | 84/726 |
| 2016/0196814 | A1* | 7/2016 | Bath | G10H 3/183 | 84/727 |

* cited by examiner

*Primary Examiner* — Marlon Fletcher
(74) *Attorney, Agent, or Firm* — Pierson IP, PLLC

(57) ABSTRACT

Embodiments disclosed herein describe systems and methods for asymmetrical bobbin configurations. Embodiments of asymmetrical bobbin configurations are configured to allow manufacturers and users to modify, adjust, change, etc. the tone of pickups. The asymmetrical bobbin configurations are configured to boost frequencies on strings on an instrument, wherein based on the configurations of the bobbins different frequencies may be modified.

13 Claims, 5 Drawing Sheets

SYSTEMS AND METHODS FOR A VARIABLE APERTURE ELECTROMAGNETIC PICKUP FOR STRINGED MUSICAL INSTRUMENTS

CROSS-REFERENCE TO RELATED APPLICATIONS

This application claims a benefit of priority under 35 U.S.C. §119 to Provisional Application No. 62/100,812 filed on Jan. 7, 2015, which is fully incorporated herein by reference in its entirety.

BACKGROUND INFORMATION

Field of the Disclosure

Examples of the present disclosure are related to systems and methods for asymmetrical bobbin configurations. More particularly, embodiments relate to a variable aperture electromagnetic pickup configured to modify the tones of stringed instruments.

Background

A pickup is a transducer that captures mechanical vibrations from string instruments, such as the electric guitar, electric bass, electric violin, etc. The pickup then converts the mechanical vibrations into an electrical signal that is amplified, recorded, or broadcast.

Conventionally, pickups are composed of two symmetrical coils, wherein each coil is wound in a reverse direction to one another, and the magnetic poles in each winding are reversed. Because the windings are reversed in each pickup coil, the electro-magnetic interference waves in each pickup are equal and antiphase. This results in the coils cancelling each other.

Although magnetic interference is cancelled in conventional coils, the produced electrical signal from is doubled. This is caused by the phase reversal of the out of phase magnets and the reversed coil windings. Accordingly, when the coils are connected in series, the voltage of the signal is approximately doubled.

Conventionally to change a guitars tone, the wiring and/or placement of symmetrical pickups is changed. For example, the polarity of the windings may be changed, which will change the interference signals and the resulting tones. However, conventional pickups do not allow certain frequencies to be increased, while modifying the volume of various strings.

Accordingly, needs exist for more effective and efficient systems and methods for asymmetrical pickups configured to variably modify frequencies and volume associated with each string.

SUMMARY

Embodiments disclosed herein describe systems and methods for asymmetrical pickup configurations. Embodiments of asymmetrical pickup configurations allow manufacturers and users to modify, adjust, change, etc. the tones of stringed instruments. Embodiments of asymmetrical pickup configurations may boost frequencies on strings of an instrument. In embodiments, based on the configurations of bobbins, different frequencies associated with the strings may be variably modified.

Embodiments may include two pickup bobbins (referred to hereinafter as "pickups"), wherein a first pickup may be configured to be positioned closer to a bridge and a second pickup may be configured to be positioned further away from the bridge. The first pickup may be configured to modify treble tones associated with strings, and the second pickup may be configured to modify bass tones associated with the strings.

Each of the pickups may include a lower flatwork, an upper flatwork, a plurality of pole pieces, and an asymmetrical bit.

The lower flatwork may be configured to be positioned over and adjacent to the strings of the instrument, and the upper flatwork may be configured to be positioned further away from the strings of the instrument.

Each of the plurality of pole pieces may be associated with a corresponding string of the instrument, wherein a pole piece may be positioned over a corresponding string. Each pole piece may extend through the body of the pickup from the lower flatwork to the upper flatwork.

The asymmetrical bit may be configured to be positioned between the lower flatwork and the upper flatwork. The asymmetrical bit may have a smaller width and diameter than the lower flatwork and the upper flatwork. The asymmetrical bit may have a first side and a second side, wherein a diameter associated with the first side of the bit may be narrower than the second side.

In embodiments, by changing the amount of wire associated with each of the strings of an instrument, the fundamental tones associated with each of the strings may be independently modified. The strings positioned under a wider end of a pickup with a larger diameter may have an increase in amplitude due to having extra wire positioned over the corresponding string. Whereas, strings positioned under the narrower end of the pickup with a smaller diameter may have less wire positioned, which may limit the amplitude of the corresponding strings.

In embodiments, because the second side of the asymmetrical bit is wider than the first side, the surface area of the wire wrapped around the second side of the asymmetrical bit may be greater than the surface area of the wire wrapped around the first side of the bit. Therefore, the second side of the asymmetrical bit may affect the corresponding strings positioned proximate to the second side of the asymmetrical bit more than the corresponding strings positioned proximate to the first side of the asymmetrical bit. Furthermore, the strings positioned closer to the ends of the sides of the asymmetrical bit may be affected more than the inner strings that are more centrally located.

In embodiments, by varying the positioning of the asymmetrical bit of the first pickup and varying the positioning of the asymmetrical bit of the second pickup, implications of the fundamental tones of the strings may be modified.

For example, in a first configuration the first side of the first pickup may be positioned over the thickest string of the instrument, and the first side of the second pickup may be positioned over the thickest string. This configuration may enable the instrument to have a tight, treble-based low end, and a thick full top end. The volume for the narrowest string may be well balanced compared to the thickest string.

In a second configuration, the first side of the first pickup may be positioned over the narrowest string, and the first side of the second pickup may be positioned over the thickest string. In this configuration, the first pickup may give the instrument a focused low end. The second pickup may limit the amount of bass on the thickest string to obtain a tight, focused attack and crisp palm muting. The narrower strings may obtain an amplified, fuller sounding tone from the second bobbin, while also getting the high end from the first bobbin. This may allow for piano-like, cleaner tones.

In a third configuration, the first side of the first pickup may be positioned over the thickest string, and the first side of the second pickup may be positioned over the narrowest string. In this configuration, the thickest string will have more bass than using a conventional pickup, but may maintain a tight focused attack. Because the second pickup picks up a wider swing of the strings than the first pickup, the second side of the second pickup may boost the bass on the thickest string, and the first side of the first pickup may maintain a tight treble focus. This configuration may be ideal for modern metal, wherein the high strings are crisper.

In a fourth configuration, the first side of the first pickup may be positioned over the narrowest string, and the first side of the second pickup may be positioned over the narrowest string. In this configuration, the first and second pickups will amplify the thicker string to obtain very crushing and heavy tones, while the narrowest string may produce cleaner tones.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
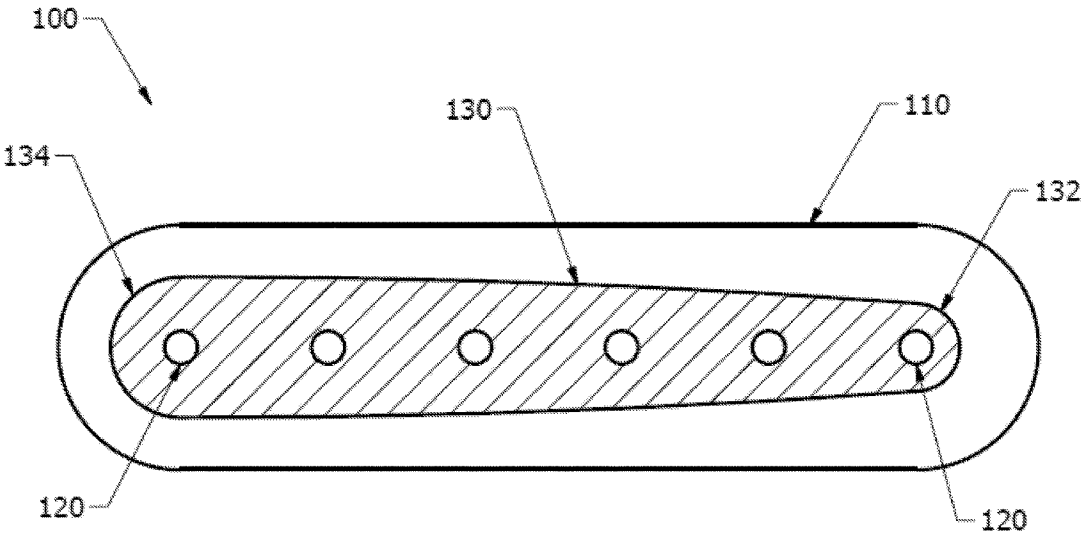
FIG. 1 depicts a variable aperture electromagnetic pickup for stringed musical instruments, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Embodiments disclosed herein describe systems and methods for asymmetrical pickup configurations. Embodiments of asymmetrical pickup configurations allow manufacturers and users to modify, adjust, change, etc. the tone of pickups. The asymmetrical pickup configurations may boost or limit amplitudes and frequencies on outer strings, while also modifying the amplitude and frequencies on the inner strings.

FIG. 1 depicts one embodiment of a variable aperture electromagnetic pickup for stringed musical instruments 100 (referred to hereinafter as "pickup 100"). In embodiments, by varying the positioning and/or orientation of the pickup 100 on a musical instrument, the electronic aperture of the fundamental tones of the strings positioned under pickup 100 may be modified.

Pickup 100 may include a lower flatwork (not shown), an upper flatwork 110, a plurality of pole pieces 120, and an asymmetrical bit 130.

The lower flatwork may be configured to be positioned over and adjacent to the strings of the musical instrument. Upper flatwork 110 may be configured to be positioned over the lower flatwork, and further away from the strings of the instruments. In embodiments, lower flatwork and upper flatwork 110 may be symmetrical pieces of pickup 100 that are vertically aligned. The lower flatwork and upper flatwork 110 may have linear and parallel sides, such that a second pickup may be positioned adjacent to pickup 100.

Pole pieces 120 may be cylindrical holes, orifices, openings, etc. that extend from lower flatwork to upper flatwork 110. There may be a plurality of pole pieces 120, wherein each pole piece is configured to be positioned over a corresponding string of the musical instrument. Each of the pole pieces 120 may be configured to concentrate and direct the electromagnetic field of a pickup 100. More specifically, each of the pole pieces 120 may concentrate the electromagnetic field caused by the vibrations of the corresponding string positioned under a pole piece 120. Via pole pieces 120, pickup 100 may convert the mechanical vibrations of a corresponding string into an electrical signal that may be amplified, recorded, etc.

Asymmetrical bit 130 may be configured to be positioned between the lower flatwork and upper flatwork 110, wherein the pole pieces 120 may extend through asymmetrical bit 130. Asymmetrical bit 130 may have a smaller width and length than upper flatwork 110. Asymmetrical bit 130 may be configured to be wrapped in wire, coil, etc. to convert the mechanical vibrations of the stringed instrument into an electrical signal.

In embodiments, asymmetrical bit 130 may have a first side 132 and a second side 134, wherein first side 132 and second side 134 are positioned on opposite ends of asymmetrical bit 130. The diameter of the first side 132 and second side 134 may be different lengths. More specifically, the sidewalls of asymmetrical bit 130 between first side 132 and second side 134 may be tapered, causing a gradual decrease in diameter across asymmetrical bit 130. In embodiments, both of the sidewalls of asymmetrical bit may be tapered, or only a single sidewall of asymmetrical bit 130 may be tapered with the other sidewall extending in a direction that is parallel to the longitudinal axis of pickup 100. Due to the changing in diameter across asymmetrical bit 130, the amount of wire positioned over each of the sides 132, 134 may change. Because the amount of wire positioned over each of the sides 132, 134 is different, the mechanical vibrations of the strings positioned under the first side 132 and the second side 134 may be converted into modified electrical signals, wherein the electrical signals are modified differently based on the different amounts of wire wrapped around asymmetrical bit 130 at different positions between first side 132 and second side 134. Furthermore, the distance between each of the pole pieces 120 and the circumference of asymmetrical bit 130 may vary for each pole piece. Accordingly, asymmetrical bit 130 may affect each string of the instrument differently based on the tapering of the sidewalls of asymmetrical bit 130.

In embodiments, the edges of asymmetrical bit 130 between first side 132 and second side 134 as well as the ends of first side 132 and second side 134 may be curved. The curvature of the edges of asymmetrical bit 130 may be configured to allow wire, coils, etc. to be easily wrapped around asymmetrical bit 130. The curvature of asymmetrical bit 130 may also be configured to allow for non-linear tonal modifications of the strings of an instrument when asymmetrical bit 130 is positioned over the strings of the instrument.

In embodiments, first side 132 may have a smaller diameter than second side 134. Because second side 134 of asymmetrical bit 130 has a larger diameter than first side 132, the surface area of the wire wrapped around second side 134 of asymmetrical bit 132 may be greater than the surface area of the wire wrapped around the first side 132. The increase in amount of wire may affect the corresponding strings positioned proximate to second side 134 of asymmetrical bit 130 more than the corresponding strings positioned proximate to first side 132 of the asymmetrical bit 130.

By varying the positioning and/or orientation (i.e. changing the direction that first side 132 or second side 134 is facing) of first side 132 and second side 134 of asymmetrical bit 130 over the narrowest string or the thickest string, the implications of the fundamental tones of the pickups may be modified. More specifically, by placing the second side 134 of asymmetrical bit 130 over the thickest string, the volume associated with the thickest string may increase by a factor that is greater than that of the narrowest string. By placing the second side 134 of asymmetrical bit 100 over the narrowest string, the volume associated with the narrowest string may increase by a factor that is greater than that of the thickest string.

In further embodiments multiple pickups 100 may be utilized with a stringed instrument, wherein a first pickup may be positioned closer to a bridge than a second pickup. The first pickup may be configured to modify treble tones associated with the strings, and the second pickup may be configured to modify the bass tones associated with the strings. By modifying the directional placement or orientation of the first side 132 and second side 134 of the multiple pickups 100, different fundamental tones may be created with the same instrument.

Figure 2:
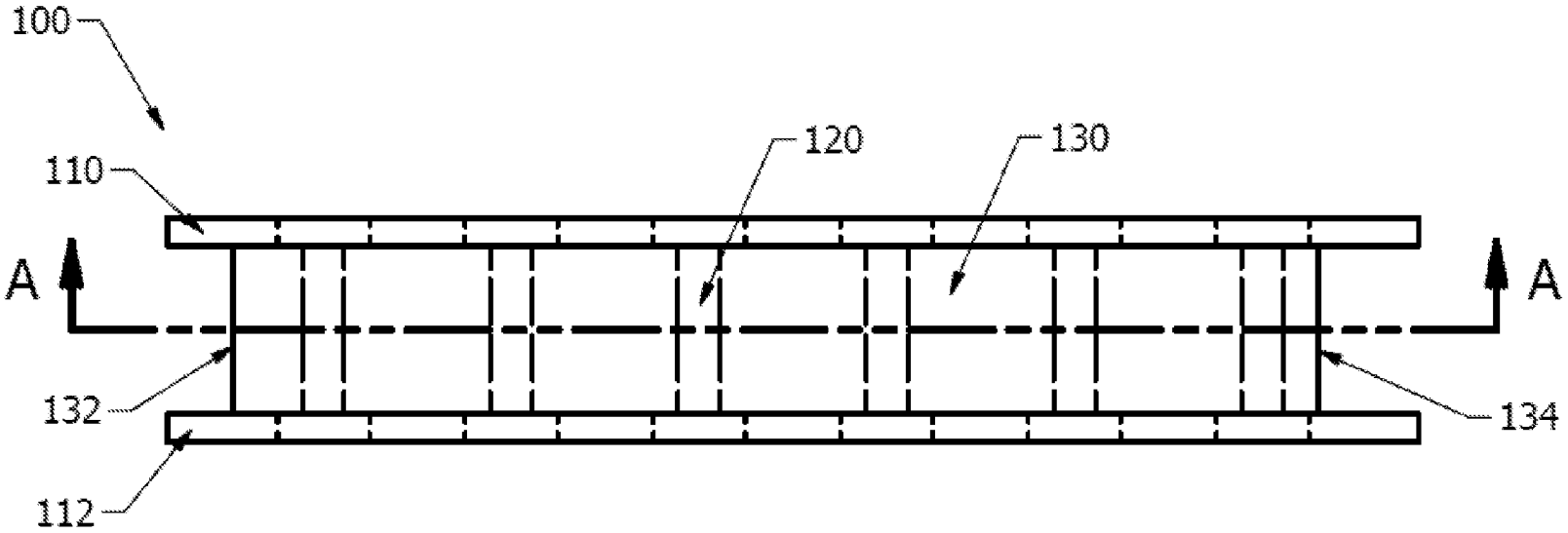
FIG. 2 depicts a side view of variable aperture electromagnetic pickup, according to an embodiment.

FIG. 2 depicts one embodiment of a side view of variable aperture electromagnetic pickup 100. As depicted in FIG. 2, upper flatwork 110 and lower flatwork 112 may be vertically aligned.

Furthermore, FIG. 2 depicts that each of the pole pieces 120 extends through the flatworks 110, 112 and asymmetrical bit 130. Additionally, pole pieces 120 extend through pickup 100 at even intervals at a direction that is perpendicular to a surface of flatworks 110, 112. As such, pole pieces 120 may extend through pickup 100 in a direction that is perpendicular to the longitudinal axis of pickup 100.

Figure 3:
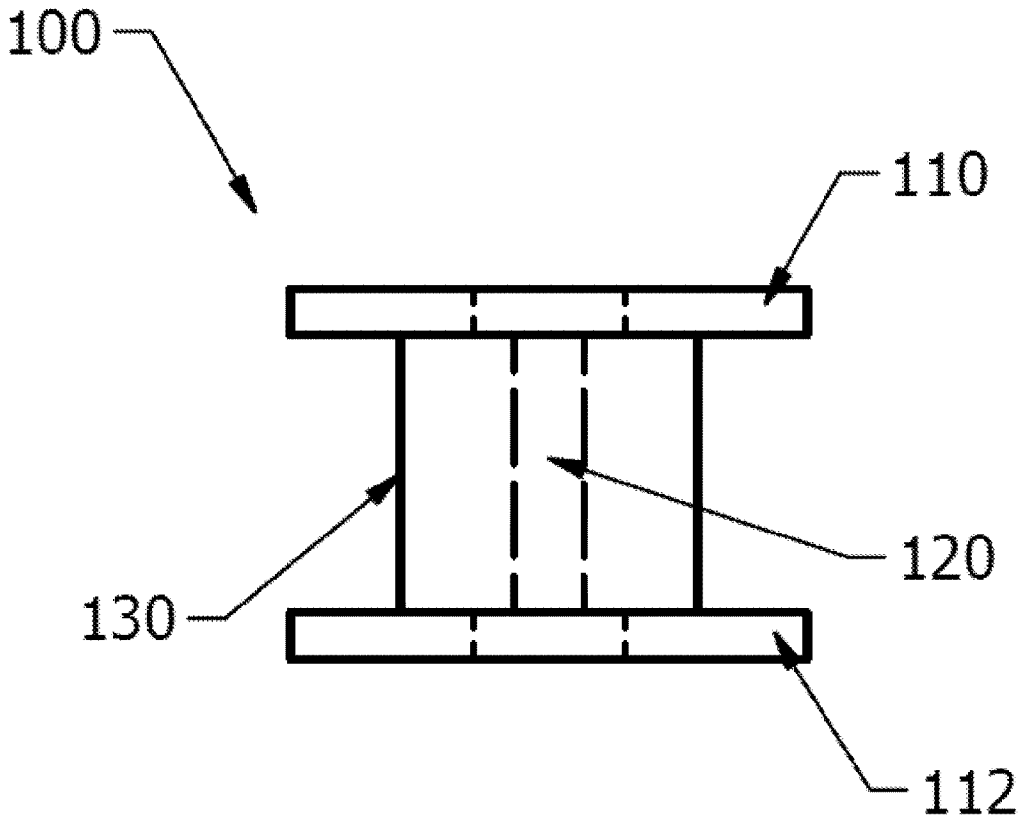
FIG. 3 depicts a side view of variable aperture electromagnetic pickup, according to an embodiment.

FIG. 3 depicts one embodiment of a side view of variable aperture electromagnetic pickup 100. As depicted in FIG. 3, the faces of upper flatwork 110 and lower flatwork 112 may be planar, flat surfaces.

Furthermore, as depicted in FIG. 3, each of the pole pieces 120 may be horizontally aligned through pickup 100. Additionally, the curvature of the sides of asymmetrical bit 130 is shown.

Figure 4:
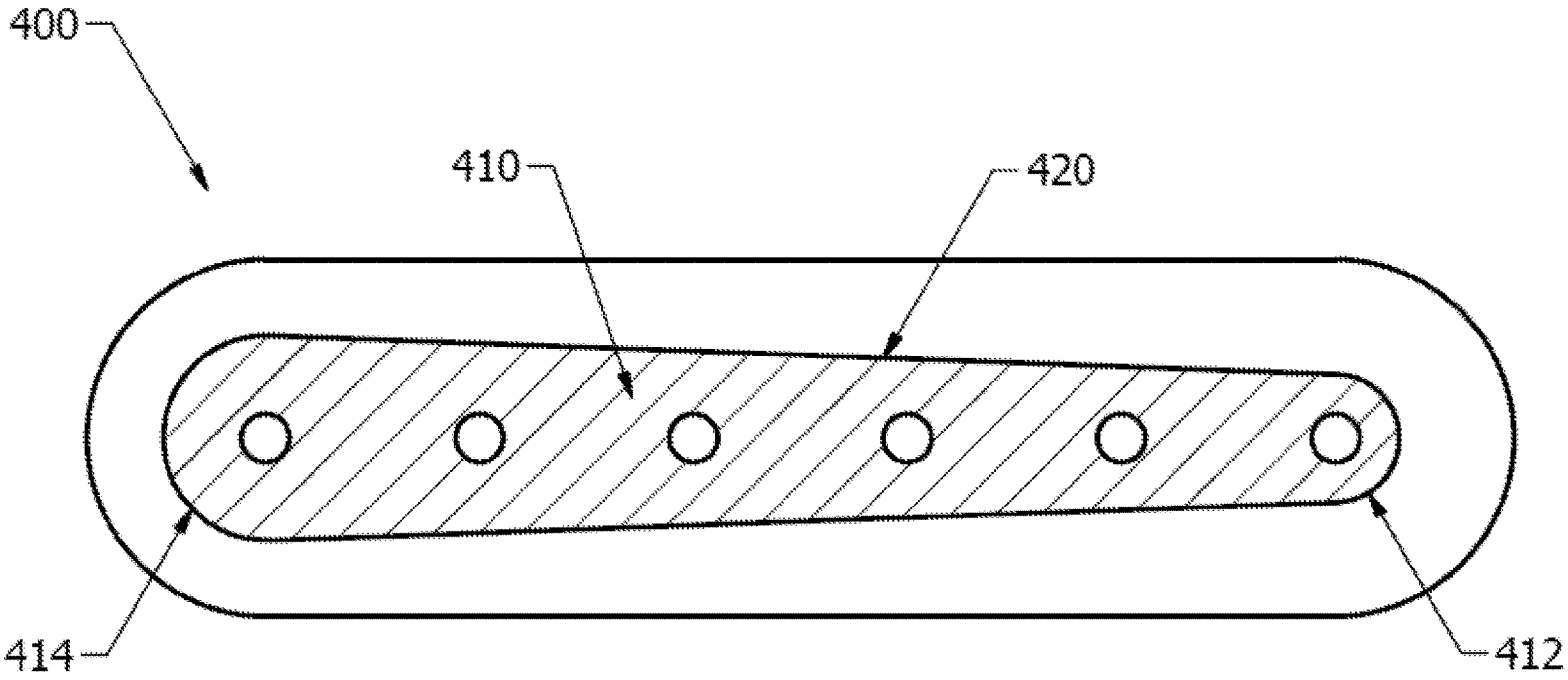
FIG. 4 depicts a variable aperture electromagnetic pickup, according to an embodiment.

FIG. 4 depicts one embodiment of variable aperture electromagnetic pickup 400. Certain elements depicted in FIG. 4 may be substantially the same as depicted in FIGS. 1-3, and for the sake of brevity another description of these elements is omitted.

As depicted in FIG. 4, the edges 420 of asymmetrical bit 410 between first side 412 and second side 414 may be linear. Furthermore, edges 420 may be tapered to be tangential to one another. An upper edge 420 from first side 412 to second side 414 may be positioned at an incline, and a lower edge 420 from first side 412 to second side 414 may be positioned at a decline. Therefore, edges 420 may be linear to amplify the tones of the strings of the instrument in a linear fashion. However, other embodiments may include curved edges 420, which may not linearly amplify the tones of the strings.

Because upper edge 420 and lower edge 420 are angled, the distance from each of the pole pieces and the circumference of asymmetrical bit 410 may be different. Consequently, asymmetrical bit 410 may affect the amplitude and/or frequency of each string of an instrument differently and independently.

Figure 5:
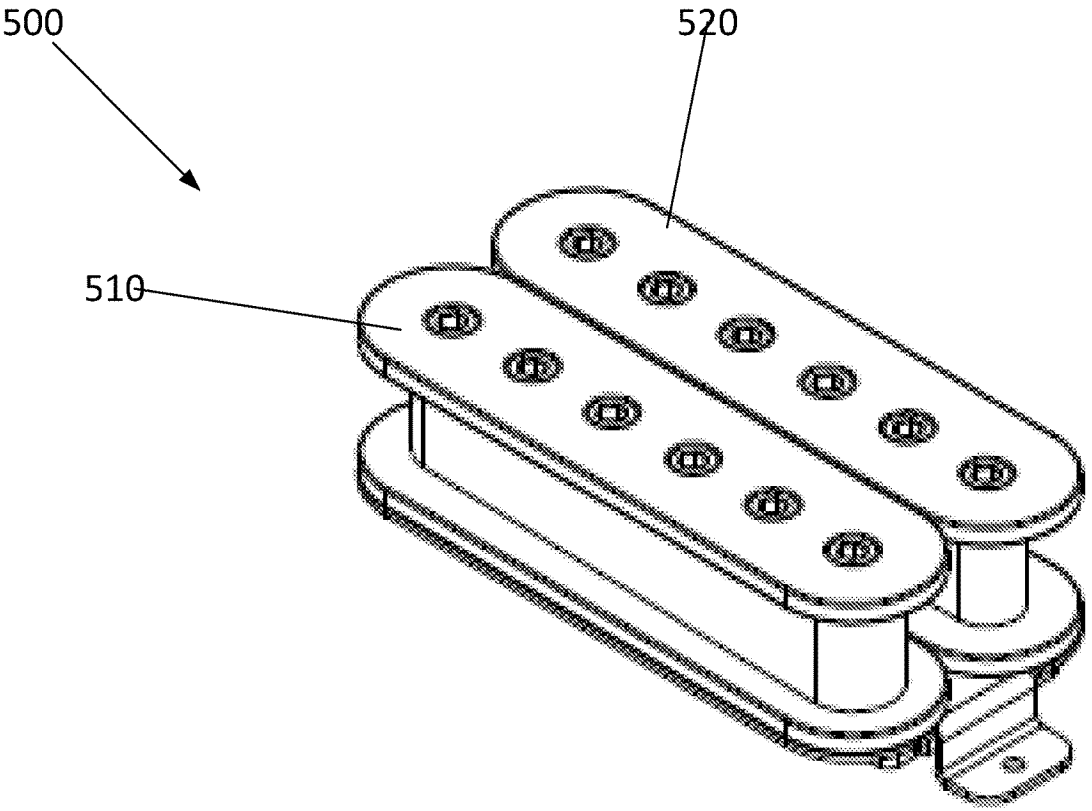
FIG. 5 depicts a variable aperture electromagnetic pickup, according to an embodiment.

FIG. 5 depicts one embodiment of variable aperture electromagnetic pickup system 500. Variable aperture electromagnetic pickup system 500 may include two removable and independent, asymmetrical pickups 510 and 520. Each of the asymmetrical pickups 510, 520 may have an asymmetrical bit between the flatworks.

In embodiments, the two asymmetrical pickups 510, 520 may be positioned in four different configurations, wherein first pickup 510 may be positioned closer to the bridge of the stringed instrument than second pickup 520. Accordingly, first pickup 510 may be configured to modify treble tones, and second pickup 520 may be configured to modify bass tones.

Responsive to positioning a first side of first pickup 510 over the thickest string or narrowest string, the tones of the treble tones may be modified. Responsive to positioning a first side of second pickup 520 over the thickest string or narrowest string, the tones of the bass tones may be modified. Thus, pickup system 500 may be positioned in four different configurations, wherein each configuration modifies the tones differently.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to one embodiment“, an embodiment”, “one example” or “an example” means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A variable pickup for a stringed musical instrument comprising:

an upper and lower flatworks, the upper and lower flatworks being symmetrical in shape;

a plurality of pole pieces extending through the variable pickup from the upper flatwork to the lower flatwork; wherein each of the pole pieces is configured to be positioned over a different string of the stringed musical instrument;

an asymmetrical bit configured to have wire positioned around an outer perimeter of the asymmetrical bit, the asymmetrical bit including a first side and a second side, wherein the first side and the second side have different diameters, wherein the asymmetrical bit is configured to amplify tones of a first string positioned under a first pole piece positioned proximate to the first side less than tones of a second string positioned under a second pole piece positioned proximate to the second side.

2. The variable pickup of claim 1, wherein the diameter of the second side is larger than the diameter of the first side.

3. The variable pickup of claim 1, wherein the surface area of second side is larger than the diameter of the first side.

4. The variable pickup of claim 1, wherein more wire is positioned around the second side than the first side.

5. The variable pickup of claim 1, wherein each of the pole pieces is configured to be positioned over a different string of the stringed musical instrument.

6. The variable pickup of claim 1, wherein a first edge positioned between the first side and the second side is a straight line.

7. The variable pickup of claim 1, wherein a first edge positioned between the first side and the second side is a curved line.

8. A system for variable aperture for stringed musical instrument comprising:

a first pickup including an first upper and a first lower flatworks, the first upper and the first lower flatworks being symmetrical in shape, wherein a first plurality of pole pieces extend through the first pickup from the first upper flatwork to the first lower flatwork, each of the first plurality of pole pieces being associated with a different string of the stringed musical instrument;

a first asymmetrical bit configured to have wire positioned around an outer perimeter of the first asymmetrical bit, the first asymmetrical bit including a first side having a first diameter and a second side having a second diameter, wherein the asymmetrical bit is tapered from the first side to the second side;

a second pickup including a second upper and a second lower flatworks, the second upper and the second lower flatworks being symmetrical in shape, wherein a second plurality of pole pieces extend through the second pickup from the second upper flatwork to the second lower flatwork, each of the second plurality of pole pieces being associated with a different string of the stringed musical instrument;

a second asymmetrical bit configured to have wire positioned around an outer perimeter of the second asymmetrical bit, the second asymmetrical bit including a third side having the first diameter and a fourth side having the second diameter, wherein the asymmetrical bit is tapered from the third side to the fourth side.

9. The system of claim 8, wherein the first pickup is configured to be positioned adjacent to the second pickup.

10. The system of claim 9, wherein tones of the strings of the musical instrument are modified based on a directional placement of the first pickup and the second pickup across the strings of the musical instrument.

11. The system of claim 10, wherein the first pickup and the second pickup are configured to be positioned in a first direction, wherein the first direction is perpendicular to a direction of the strings of the musical instrument.

12. The system of claim 10, wherein the first pickup is configured to be positioned in a first direction, and the second pickup is configured to be positioned in a second direction.

13. The system of claim 8, further comprising:

first wire is wrapped around the first asymmetrical bit, wherein an amount of the first wire wrapped around the first side of the first asymmetrical bit is greater than the amount of the first wire wrapped around the second side of the first asymmetrical bit.

* * * * *